US012486661B2

(12) United States Patent
Fenton

(10) Patent No.: US 12,486,661 B2
(45) Date of Patent: Dec. 2, 2025

(54) CHANNEL CLIP

(71) Applicant: Catalyst Acoustics Group, Inc., Agawam, MA (US)

(72) Inventor: Douglas Earl Fenton, Patriot, OH (US)

(73) Assignee: Catalyst Acoustics Group, Inc., Agawam, MA (US)

( * ) Notice: Subject to any disclaimer, the term of this patent is extended or adjusted under 35 U.S.C. 154(b) by 383 days.

(21) Appl. No.: 17/675,403

(22) Filed: Feb. 18, 2022

(65) Prior Publication Data

US 2023/0265650 A1 Aug. 24, 2023

(51) Int. Cl.
*E04B 1/41* (2006.01)
*E04B 1/38* (2006.01)
*E04B 9/00* (2006.01)

(52) U.S. Cl.
CPC ..... *E04B 1/388* (2023.08); *E04B 9/001* (2013.01)

(58) Field of Classification Search
CPC ..... E04B 1/388; E04B 9/001
USPC ..... 52/704
See application file for complete search history.

(56) References Cited

U.S. PATENT DOCUMENTS 3,981,116 A 9/1976 Reed
D314,438 S * 2/1991 Meyers ..... D25/11
5,203,135 A * 4/1993 Bastian ..... F16B 7/0413 403/292
6,601,362 B1 * 8/2003 Prince ..... E04F 19/022 52/844
6,668,495 B1 * 12/2003 Prince ..... E04F 19/022 52/656.1
6,755,004 B1 * 6/2004 Power, Jr. ..... E04C 3/06 52/579
7,628,563 B2 * 12/2009 Winkler ..... F16B 12/50 403/387
7,832,180 B2 * 11/2010 Dolby ..... E04B 2/96 52/235
D652,986 S * 1/2012 Trzesniowski ..... D26/138
8,752,338 B2 * 6/2014 Schaefer ..... H01R 4/64 52/173.3
8,869,490 B2 * 10/2014 Schaefer ..... F24S 25/70 52/60
9,932,734 B1 * 4/2018 Winter ..... E04B 1/1903
10,640,968 B2 * 5/2020 Teffenhart, Jr. ..... E04B 1/2403
D954,301 S * 6/2022 Hendry ..... D25/131
D1,019,992 S * 3/2024 Hickey ..... D25/119
11,939,781 B2 * 3/2024 Fabbi ..... A62B 35/0068
2007/0266671 A1 * 11/2007 Chromy ..... E04C 3/06 52/844

(Continued)

FOREIGN PATENT DOCUMENTS

CA 3050232 A1 3/2020
CN 111305451 A 6/2020

(Continued)

*Primary Examiner* — James J Buckle, Jr.
(74) *Attorney, Agent, or Firm* — Harris Beach Murtha Cullina PLLC

(57) ABSTRACT

A channel clip used to secure an acoustically isolated ceiling via an acoustic isolator, which includes a centrally positioned bore for attachment to the isolator and an interior protrusion for limiting movement of a channel within the clip. A method of manufacturing a channel clip, including extrusion of tubing from which the clip is cut, and a method of installing a channel clip are also provided.

14 Claims, 6 Drawing Sheets

(56) References Cited

U.S. PATENT DOCUMENTS

| | | | | |
|---|---|---|---|---|
| 2008/0250737 | A1* | 10/2008 | Hall | E04C 3/06 52/223.9 |
| 2009/0178360 | A1* | 7/2009 | Teffenhart, Jr. | E04C 3/06 52/745.19 |
| 2012/0167505 | A1* | 7/2012 | Krause | E04F 13/0817 52/302.1 |
| 2013/0174506 | A1* | 7/2013 | Bombino | E04B 1/388 52/750 |
| 2013/0186031 | A1* | 7/2013 | Ting | E04B 1/388 52/698 |
| 2018/0094426 | A1* | 4/2018 | Winter | E04F 11/1817 |
| 2018/0363294 | A1* | 12/2018 | Galas | E04B 5/026 |
| 2020/0191485 | A1* | 6/2020 | Chambers | F27D 1/141 |
| 2020/0224408 | A1* | 7/2020 | Thrift | F16B 5/123 |

FOREIGN PATENT DOCUMENTS

| | | | |
|---|---|---|---|
| CN | 112343238 | A | 2/2021 |
| JP | 3694697 | B2 | 9/2005 |
| JP | 2008163635 | A | 7/2008 |
| KR | 101580972 | B1 | 12/2015 |
| KR | 101895402 | B1 | 9/2018 |

* cited by examiner

CHANNEL CLIP

FIELD OF THE TECHNOLOGY

The present technology relates to suspended and isolated ceilings. More specifically, this technology relates to a channel clip for supporting channels, such as cold rolled channels, and other structures.

BACKGROUND

An acoustic isolator is a passive isolation system having mass, spring, and damping elements that move as a harmonic oscillator. Damping action of the acoustic isolator causes energy dissipation and therefore noise reduction. Acoustic isolators are typically mounted on a ceiling structure (including, but not limited to, a joist or concrete deck) of a building. A channel clip is affixed to the acoustic isolator to support a channel, such as a cold rolled channel. The acoustic isolator, channel clip, and channel constitutes a hanger assembly. Cold rolled channels suspended in this fashion constitute the main framing of an acoustically isolated ceiling. Gypsum board (i.e., drywall) and/or other ceiling materials are then mounted to and supported by the channel.

FIG. 1 illustrates an acoustic isolator and channel clip configuration according to the conventional art. An acoustic isolator 12 is suspended from a joist (not shown). The acoustic isolator 12 has internal elements that damp vibrations. A channel clip 16 is attached to a rod 22 extending from the acoustic isolator 12. A cold rolled channel 14 is passed through the channel clip 16 for support. Gypsum board or other ceiling material (not shown) is then supported by the cold rolled channel and other cold rolled channels supported in the same manner. As is known in the art, a conventional cold rolled channel has a web 18, and two flanges 20.

The channel clip 16 according to the conventional art has disadvantages. Its design is "eccentric" (i.e. offset). This means that the load supported by the conventional clip and the point at which the clip attaches to the isolator are on different vertical axes. In FIG. 1, for example, the channel 14 is supported to the right of the center axis of the isolator 12. The eccentric or offset design limits the amount of weight that the channel clip can support, regardless of the strength of the rest of the hanger assembly and can degrade the performance of the isolator. The offset load pulls on the isolator at an angle instead of in line with the axis of the isolator's support rod. Another disadvantage is that convention channel clips 16 are not adaptable to different sizes of channel, which requires different size clips to accommodate different size channels.

What is needed, therefore, is a channel clip that provides improved performance, ease of installation, or other desirable attributes. What is also needed is a channel clip that is simple and inexpensive to manufacture.

SUMMARY

Accordingly, some embodiments of the present disclosure address the foregoing needs in the art. According to a first embodiment, a channel clip for supporting a channel is provided, the clip comprising: a top wall having a first end and a second end opposite the first end; a bottom wall parallel to the top wall, and having a first end and a second end opposite the first end; a first side wall extending from the first end of the top wall to the first end of the bottom wall;

a second side wall parallel to the first side wall and extending from the second end of the top wall to the second end of the bottom wall; a protrusion extending from the first side wall and towards the second side wall, and configured to reduce movement of a channel disposed in the clip along a direction parallel to the first and second side walls, and a bore extending through a center of the top wall.

In some embodiments, the clip comprises a unitary body formed by an extrusion process. In some embodiments, the unitary body has a rectangular cross section. In some embodiments, the protrusion is disposed at a location on the first side wall that is approximately 0.25 inches from the bottom wall to limit the channel from moving relative to the clip. In some embodiments, the protrusion has a rectangular cross section.

In some embodiments, the bore is a threaded bore. In some embodiments, the bore is a first bore, and the clip further comprises a second bore that is a threaded bore and that extends through the center of the bottom wall.

In some embodiments, the channel clip is configured to be supported by an acoustic isolator via the first bore. In some embodiments, the channel clip is configured to support at least one secondary structure via the second bore.

In some embodiments, the channel clip is configured to interchangeably accommodate a ¾" cold rolled channel, a 1½" cold rolled channel, a 2" cold rolled channel, and a 2½" cold rolled channel.

In some embodiments, the protrusion is configured to constrain a flange of the channel, and the channel extends through an interior volume of the clip defined by the top wall, the bottom wall, the first side wall, and the second side wall. In some embodiments, the protrusion is a first protrusion, and the clip further comprises at least one second protrusion, the first and second protrusions positioned to form a notch to limit movement of the channel disposed in the clip along the direction parallel to the first and second side walls. In some embodiments, the protrusion limits movement of the channel to between approximately 0.180 and 0.210 inches of distance along the direction.

According to a second embodiment of the present disclosure, a method of making a channel clip is provided, comprising the steps of: extruding rectangular tubing, comprising: forming a top wall, a bottom wall, and two side walls, wherein the top and bottom walls are shorter than the side walls; and forming an interior rib along the length of the rectangular tubing in a direction of the extrusion, the rib configured to constrain a flange of a channel, boring a hole in a center of the top wall of the rectangular tubing; and tapping the hole so that the tubing is configured to be supported by an acoustic isolator via the bore.

In some embodiments, the method further comprises cutting the tubing perpendicular to the length of the tubing to form rectangular clips, and wherein the step of boring a hole in a center of the top wall comprises boring a hole in the top wall of each clip and the step of tapping the hole comprises tapping each hole in each clip. In some embodiments, the method further comprises boring a second hole in the bottom wall of each clip and tapping each second hole.

In some embodiments, the step of boring a hole in the center of the top wall comprises boring a plurality of holes along a center line of the rectangular tubing, and the method further comprising cutting the tubing perpendicular to the length of the tubing to form rectangular clips, each with a hole in the center of the top wall. In some embodiments, the method further comprises the step of boring a plurality of second holes in the bottom wall along a center line of the rectangular tubing, such that the cut clips each have a hole in the center of the bottom wall.

According to another embodiment of the present disclosure, a method of constructing an acoustically isolated ceiling is provided, comprising the steps of: attaching an acoustic isolator to a ceiling structure, the acoustic isolator having a threaded rod; threading a rectangular channel clip onto the threaded rod, the clip comprising a top wall, a bottom wall, two side walls, and a threaded hole extending through a center of the top wall; passing a channel through the rectangular clip such that a flange of the channel passes between a protrusion on a side wall of the clip and the bottom wall of the clip; and attaching a ceiling material to the channel.

In some embodiments, the method further comprises the step of securing at least one secondary structure to a second hole formed in the bottom wall of the clip. In some embodiments, the ceiling structure is one of a joist or concrete deck.

Additional details and feature of embodiments of the technology will now be described in connection with the following drawings.

BRIEF DESCRIPTION OF THE DRAWINGS

The drawings show embodiments of the disclosed subject matter for the purpose of illustration. However, it should be understood that the present application is not limited to the precise arrangements and instrumentalities shown in the drawings, wherein.

DETAILED DESCRIPTION

Figure 1:
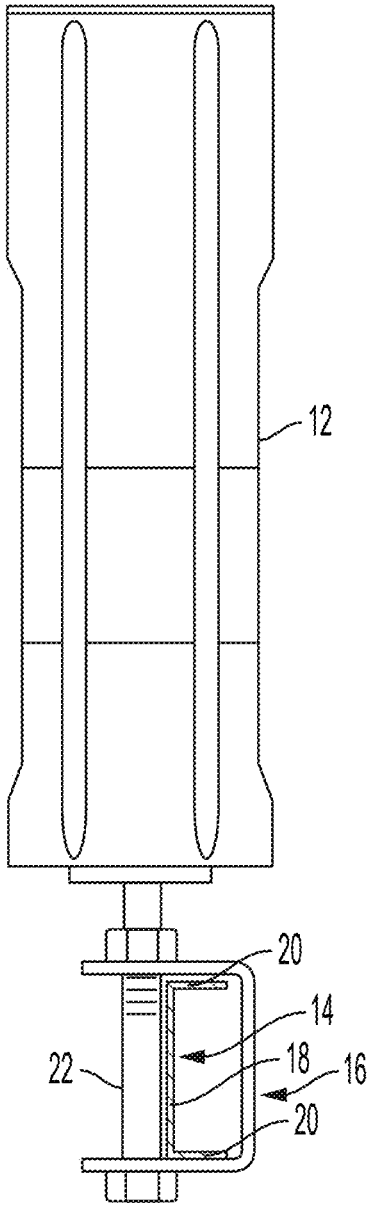
FIG. 1 PRIOR ART
FIG. 1 is a front view of an acoustic isolator and channel clip according to the prior art.
Figure 2:
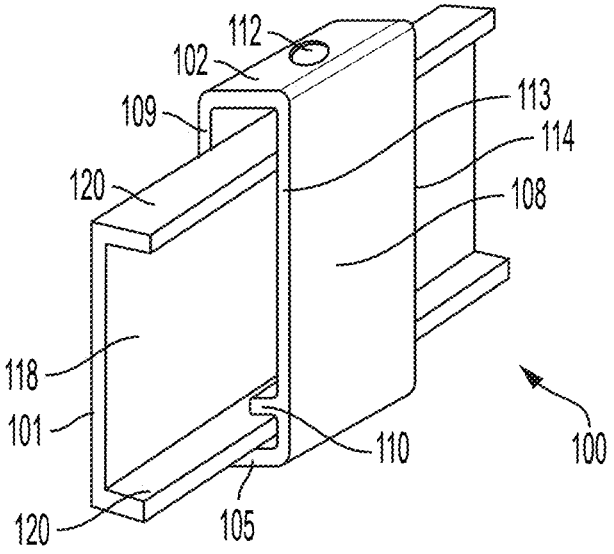
FIG. 2 is a perspective view of a channel clip according to a first embodiment of the present technology.
Figure 3:
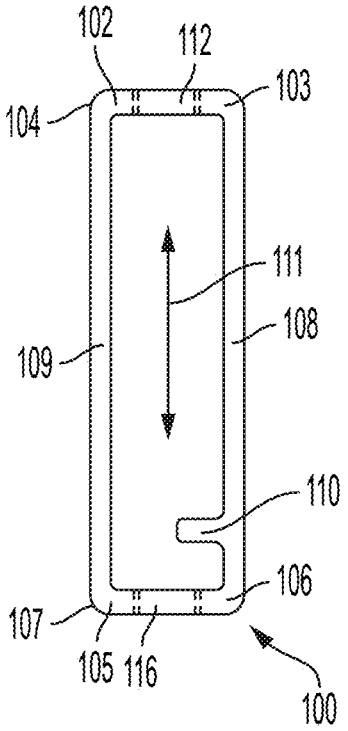
FIG. 3 is a front view of the channel clip of FIG. 2.
Figure 4A:
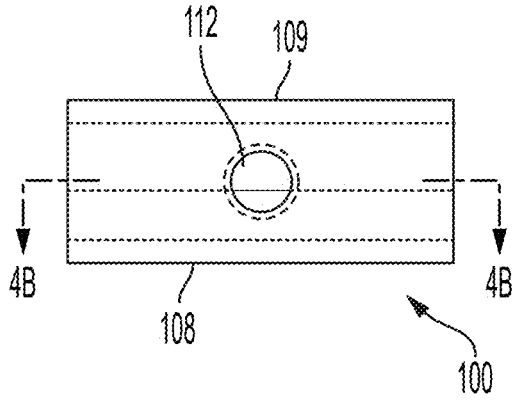
FIG. 4*a* is a top view of the channel clip of FIG. 2.

Embodiments of the present technology will now be described with reference to the drawings. FIGS. 2, 3, and 4*a*/4*b* show a first embodiment of a channel clip 100 according to the present technology. In this embodiment, the channel clip 100 is for supporting a channel 101, such as a cold rolled steel channel, used to support ceiling materials or other structures (not shown). As mentioned above, the channel 101 in this embodiment comprises a web 118 between two flanges 120 that are arranged perpendicularly to the web 118.

In this embodiment, the clip comprises a top wall 102 having a first end 103 and a second end 104 opposite the first end, and a bottom wall 105 parallel to the top wall, and also having a first end 106 and a second end 107 opposite the first end. The top and bottom walls are connected by first and second side walls 108 and 109, respectively. The first side wall 108 extending from the first end 103 of the top wall to the first end 106 of the bottom wall. The second side wall 109 is parallel to the first side wall in this embodiment and extends from the second end 104 of the top wall to the second end 107 of the bottom wall. In this embodiment, a protrusion 110 extends from the first side wall 108 and towards the second side wall 109. The protrusion 110 is configured to limit movement of a channel 101 disposed in the clip along a direction 111 parallel to the first and second side walls. In this embodiment, the protrusion 110 restrains the channel 101 against, for example, being pushed upward within the clip 100 when other equipment is installed on the ceiling supported by the clip. Those of skill in the art will understand that the protrusion 110 can be formed on either or both of sidewalls 108 or 109.

In this embodiment, a bore 112 extends through a center of the top wall 102. In some embodiments, the bore 112 is a threaded bore that engages with a rod having corresponding threads, such as the threaded rod on an acoustic isolator. In this embodiment, the clip 100 is configured to be supported by an acoustic isolator via the bore 112. In this embodiment, the center of the top wall of the clip refers to a point equidistant from each of the side walls, as well as equidistant from the front 113 and the back 114 of the clip. In this embodiment, this centering of the bore 112 relative to the sides and front and back ends of the clip 100 enables the clip to bear loads evenly, i.e., in a "concentric" manner. In some embodiments, this feature enables a more efficient use of the material of the clip—i.e., it improves the load-bearing strength of the design versus some other conventional "eccentric" clip designs. In some other embodiments, the bore is centered only with respect to the side walls, and in some other embodiments, the bore is centered only with respect to the front and back ends of the clip. In this and some other embodiments of the technology, various acoustic isolation hangers can be used to support the clip 100: for example, Kinetics Noise Control, Inc.'s ICC™ Deck-Suspended Ceiling Hanger, ICW™ Wood-Frame Ceiling Hanger, and the GOTHAM™ Spring Ceiling Hanger, KSCH™ Low Profile Deck-Suspended Ceiling Hanger, KSCH-APB™ Spring Isolation Hanger can be used, among others.

In this and some other embodiments, the clip 100 further comprises a second bore 116 through the center of the bottom wall 105. In this embodiment, second bore 116 is a threaded bore. In this and some other embodiments, the channel clip 100 is configured to support at least one secondary structure via the second bore 116. Examples of such secondary structures include secondary ceiling materials, HVAC equipment, ducts, pipes, cable trays, lighting, sound absorption materials, etc.

As shown in FIG. 2, in this embodiment, the protrusion 110 is configured to constrain a flange 120 of the channel 101. In this embodiment, the channel 101 extends through the interior volume of the clip defined by the top wall, the bottom wall, the first side wall, and the second side wall. In some other embodiments, the protrusion 110 engages a different part of the channel, especially in embodiments in which the channel 101 has a different shape that the conventional U-channel design. As one example, some embodiments are sized to accommodate channels having more square dimensions, such as channels with flanges that are 1 inch long instead of the more typical 0.5 inch length.

Figure 5:
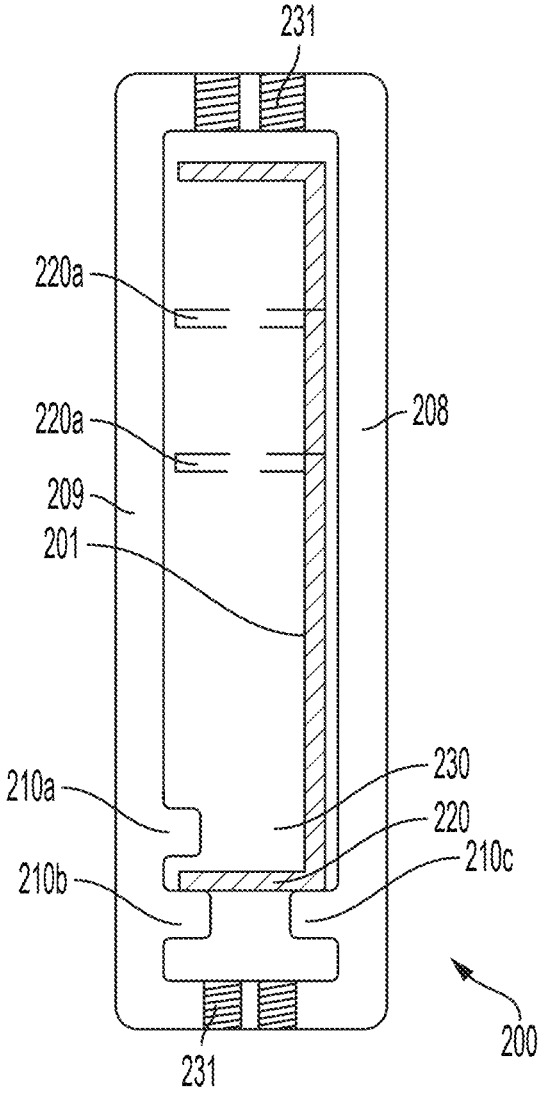
FIG. 5 is a front view of a channel clip according to an alternative embodiment of the present technology.

Some embodiments include multiple protrusions on one or both sidewalls of the clip. In some such embodiments, the protrusions are positioned to form a notch for restraining the channel flange. An example of such an embodiment is shown in FIG. 5, and is shown below. In some embodiments, the clip comprises at least two protrusions positioned to form a notch to limit movement of the channel disposed in the clip along the direction parallel to the first and second side walls.

Figure 4B:
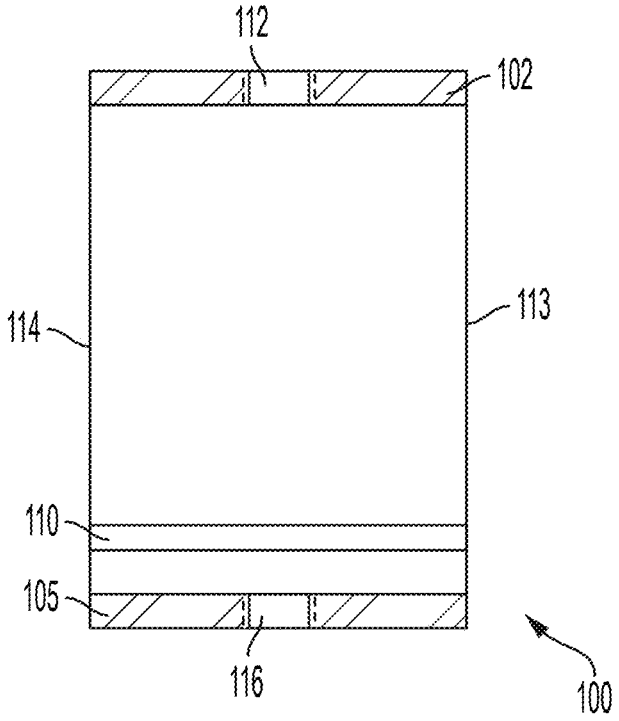
FIG. 4*b* is a cross section view of the channel clip of FIG. 2 taken along line A-A in FIG. 4*a*.

In the embodiment of FIGS. 2-4, the protrusion 110 is disposed at a location on the first side wall 108 that is approximately 0.25 inches from the bottom wall to limit the channel from moving relative to the clip. In some embodiments, the protrusion is located to ensure that the distance that the channel is permitted to move within the clip is smaller than the thickness of the channel material. In this embodiment, the 0.25 inch separation is chosen to ensure that the clip 100 can accommodate channels of different gauges (i.e., metal thicknesses). For 16 gauge cold rolled channel, the 0.25 inch separation limits movement of the channel to a distance of approximately 0.190-0.196 inches along the direction 111. For 18 gauge cold rolled channel, the range of permitted movement is slightly larger, or approximately 0.202 inches. In some other embodiments, different separations are selected, including smaller separations that more severely restrict the ability of the channel to move with respect to the clip. In some embodiments, the protrusion limits movement of the channel along the direction to between approximately 0.150 inches and 0.23 inches of distance or travel. In other embodiments, the distance (or travel) of the channel is limited to between 0.180 and 0.210. In still other embodiments, the distance is limited to between 0.190 and 0.2. In this embodiment, the protrusion 110 has a rectangular cross section. In some other embodiments, the protrusion's cross-section has other shapes, including a rounded or triangular shape.

In this and some other embodiments, the clip comprises a unitary body that is formed by extrusion. In some embodiments, the clip is formed of a single piece of material. In some embodiments, the clip is formed of aluminum.

In the embodiment shown in FIGS. 2-4, the clip has a rectangular cross section. In some other embodiments, the clip has a square cross section, for instance, to accommodate a channel with 1 inch long flanges. In some other embodiments, other shapes are used, such as an octagonal shape, in which additional walls connect the side walls to the top and bottom walls, such additional walls disposed at angles with respect to the top, bottom, and side walls.

In this embodiment, the channel clip is configured to interchangeably accommodate a ¾" cold rolled channel, a 1½" cold rolled channel, a 2" cold rolled channel, and a 2½" cold rolled channel. These dimensions refer to the width of the web 18, 118 of the channel. The protrusion allows smaller sized channels to be used without concern of the channel being undesirably mobile within the clip. In this embodiment, the clip's overall height is 2.96 inches from the top of the top wall to the bottom of the bottom wall. In this embodiment, the clip's overall width is 0.86 inches and the length of the clip (i.e., the dimension parallel to the extrusion direction) is 2.00 inches. In this embodiment, the clip's interior width is 0.62 inches+/−0.01 inches, and its interior height is 2.66 inches+/−0.03 inches. In some embodiments, the clip's interior width is in the range of approximately 0.58-0.64 inches. In some embodiments, the clips interior height is in the range of approximately 2.5-3 inches. In this embodiment, the protrusion extends 0.25 inches from the first sidewall 108, and is located 0.25 inches from the bottom wall 105. In this embodiment, the center of the bore 112 is located 1.00 inches from the front and back ends of the clip and 0.430 inches from the outside surfaces of the sidewalls. The second bore 116 is located the same distances from the ends and sides of the clip. In this embodiment, the sidewall thickness is approximately 0.12 inches and the top and bottom wall thicknesses is approximately 0.15 inches. In other embodiments, these dimensions are adjusted to accommodate design, manufacturing, and installation differences.

Clips according to this and some other embodiments provide advantages over conventional channel clips. For example, the clip according to this embodiment requires only a threaded rod to be installed—it does not require additional washers, nuts or hardware like some conventional channel clips. This can result in less installation cost. The clip according to this embodiment can be used "mid-span" on a channel without the isolation hanger in order to support additional equipment or ceilings, and its improved strength allows for fewer points of contact with structure. Also, because some embodiments are able to accommodate channels of larger sizes, such clips are capable of supporting longer spans of larger channel (e.g., up to 65" between clips, instead of only 48" between clips), thereby making it easier to avoid ducts during ceiling installation. In some embodiments, the clip eliminates the need for preloading the spring in the isolator, allows for easier assembly, and offers the added ability to change springs in the field without special tools and headaches.

FIG. 5 shows an alternative embodiment of a clip 200 according to the present technology. Clip 200 includes three protrusions 210*a*, 210*b*, and 210*c*, where two are on second sidewall 209 and one is on first sidewall 208. The protrusions 210*a*, 210*b*, and 210*c* create a notch 230 for receiving the flange 220 of a channel 201. FIG. 5 also shows threads 231 in the bores disposed in the top and bottom walls of the clip 200. FIG. 5 also shows, in broken lines, flanges 220*a* that represent smaller channels disposed in the clip 200.

According to another embodiment of the present technology, a method of making a channel clip is provided. According to one embodiment, the method comprises the step of extruding a length of tubing, which comprises forming a top wall, a bottom wall, and two side walls, wherein the top and bottom walls are shorter than the side walls, and forming an interior rib along the length of the tubing in a direction of the extrusion, the rib configured to constrain a flange of a channel. In this embodiment, the method also comprises boring a hole in a center of the top wall of the rectangular tubing; and tapping the hole so that the tubing is configured to be supported by an acoustic isolator via the bore.

In some embodiments, the extruded tubing has a rectangular cross section, as shown in FIGS. 2-5.

Figure 6:
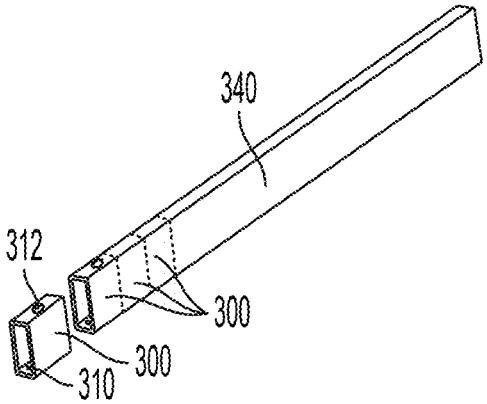
FIG. 6 shows a perspective view of an extruded tubing according to an embodiment of the invention.

In some embodiments, as shown in FIG. 6, the method further comprises cutting the tubing 340 perpendicular to the length of the tubing into sections to form rectangular clips 300. The rib formed along the length of the extruded tubing now forms the protrusion 310 in each clip 300. In some embodiments, the step of boring a hole 312 in a center of the top wall is then performed on the top wall of each section of tubing and the step of tapping the hole comprises tapping each hole in each section of tubing, i.e., each individual clip 300. In some embodiments, the method further comprises boring a second hole in the bottom wall of each section and tapping each second hole.

Figure 7:
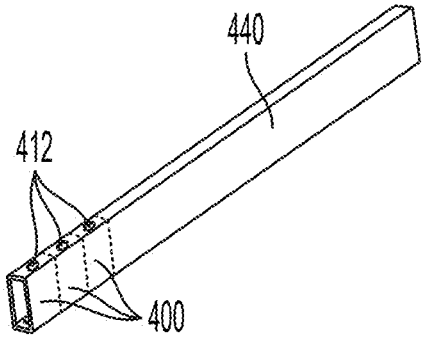
FIG. 7 shows a perspective view of an extruded tubing according to an embodiment of the invention.

In some other embodiments, such as shown in FIG. 7, the step of boring a hole 412 in the center of the top wall comprises boring a plurality of holes along a center line of the rectangular tubing 440, and the method further comprising cutting the tubing perpendicular to the length of the tubing into section to form rectangular clips 400, each with a hole in the center of the top wall. In some embodiments, the method further comprises the step of boring a plurality of second holes in the bottom wall along a center line of the rectangular tubing, such that the cut sections each have a hole in the center of the bottom wall.

Figure 8:
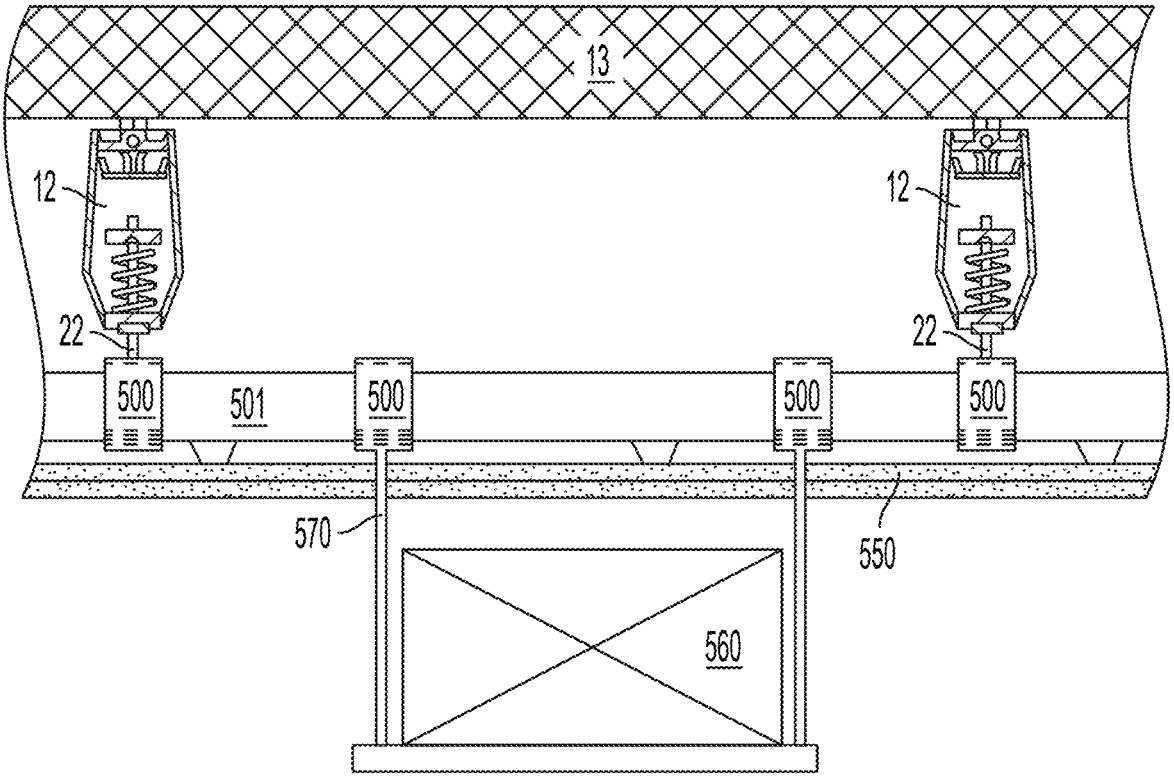
FIG. 8 shows a schematic view of a ceiling installation according to an embodiment of the invention.

According to another embodiment of the present technology, a method of constructing an acoustically isolated ceiling is provided. In reference to FIG. 8, the method comprises attaching an acoustic isolator 12 to a ceiling structure 13, the acoustic isolator having a threaded rod 22. A rectangular channel clip 500 is threaded onto the threaded rod, the clip comprising a top wall, a bottom wall, two side walls, and a threaded hole extending through a center of the top wall. A channel 501 is passed through the rectangular clip such that a flange of the channel passes between a protrusion on a side wall of the clip and the bottom wall of the clip (see FIG. 2, for example). Ceiling material 550 is attached to the channel. In the embodiment shown, the ceiling structure is a joist. In other embodiments, the ceiling structure is a concrete deck or slab.

In some embodiments, the method further comprises the step of securing at least one secondary structure 560 to a second hole formed in the bottom wall of the clip 500. This is achieved in some embodiments by attaching rods 570 to the second hole using a threads. The secondary structure can take many forms, as discussed above.

Thus, some embodiments of the present technology provide channel clips that are resilient and adaptable. Channel clips according to some embodiments yield better isolated ceiling systems allowing use of different framing systems, e.g., drywall, equipment, cable trays, for successful isolation of the entire ceiling system. Some embodiments of the channel clips support a range of cold rolled channel/drywall furring channel available on the market for isolating a ceiling to control noise.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed is:

1. A detachable channel clip for supporting a U-shaped channel, the clip comprising:

a top wall having a first end and a second end opposite the first end;

a bottom wall parallel to the top wall, and having a first end and a second end opposite the first end;

a first side wall extending from the first end of the top wall to the first end of the bottom wall;

a second side wall parallel to the first side wall and extending from the second end of the top wall to the second end of the bottom wall;

a protrusion extending from the first side wall and towards the second side wall, and configured to reduce movement of the channel disposed in the clip along a direction parallel to the first and second side walls, wherein a portion of the second side wall directly opposite the protrusion and facing the protrusion has a planar surface configured to engage and support a web of the U-shaped channel when the channel is inserted into an interior volume of the clip, and a bore extending through a center of the top wall;

wherein the interior volume is dimensioned to allow the web of the U-shaped channel to pass completely through and be supported by the planar surface of the second side wall.

2. The channel clip of claim 1, wherein the clip comprises a unitary body formed by an extrusion process.

3. The channel clip of claim 1, wherein the unitary body has a rectangular cross section.

4. The channel clip of claim 1, wherein the protrusion is disposed at a location on the first side wall that is approximately 0.25 inches from the bottom wall to limit the channel from moving relative to the clip.

5. The channel clip of claim 1, wherein the protrusion has a rectangular cross section.

6. The channel clip of claim 1, wherein the bore is a threaded bore.

7. The channel clip of claim 6, wherein the bore is a first bore, and the clip further comprises a second bore that is a threaded bore and that extends through the center of the bottom wall.

8. The channel clip of claim 6, wherein the channel clip is configured to be supported by an acoustic isolator via the first bore.

9. The channel clip of claim 7, wherein the channel clip is configured to support at least one secondary structure via the second bore.

10. The channel clip of claim 1, where the channel clip is configured to interchangeably accommodate a ¾" cold rolled channel, a 1½" cold rolled channel, a 2" cold rolled channel, and a 2½" cold rolled channel.

11. The channel clip of claim 1, wherein the protrusion is configured to constrain a flange of the channel, and the channel extends through an interior volume of the clip defined by the top wall, the bottom wall, the first side wall, and the second side wall.

12. The channel clip of claim 1, wherein the protrusion is a first protrusion, and further comprising at least one second protrusion, the first and second protrusions positioned to form a notch to limit movement of the channel disposed in the clip along the direction parallel to the first and second side walls.

13. The channel clip of claim 1, wherein the protrusion limits movement of the channel to between approximately 0.180 and 0.210 inches of distance along the direction.

14. A channel clip for supporting a channel, the clip comprising:

a top wall having a first end and a second end opposite the first end;

a bottom wall parallel to the top wall, and having a first end and a second end opposite the first end;

a first side wall extending from the first end of the top wall to the first end of the bottom wall;

a second side wall parallel to the first side wall and extending from the second end of the top wall to the second end of the bottom wall;

a first protrusion extending from the first side wall and towards the second side wall, wherein the first protrusion is perpendicular to the first side wall, a bore extending through a center of the top wall, and at least one second protrusion extending from the first side wall and towards the second side wall adjacent the first protrusion, wherein the at least one second protrusion is perpendicular to the side wall, wherein the first and second protrusions positioned to form a notch that accommodates a flange of the channel therebetween to limit movement of the channel disposed in the clip along the direction parallel to the first and second side walls.

* * * * *